United States Patent [19]

Liao

[11] Patent Number: 5,046,969

[45] Date of Patent: Sep. 10, 1991

[54] SOCKET SET

[76] Inventor: Nan W. Liao, No. 18, Zee Jou Road, Hsinchu, Taiwan

[21] Appl. No.: 556,393

[22] Filed: Jul. 24, 1990

[51] Int. Cl.[5] ..... H01R 13/506

[52] U.S. Cl. ..... 439/686

[58] Field of Search ..... 439/686, 668, 621, 622

[56] References Cited

U.S. PATENT DOCUMENTS

| | | | |
|---|---|---|---|
| 2,954,544 | 9/1960 | Focosi | 439/668 |
| 3,377,610 | 4/1968 | Busch et al. | 439/622 |
| 4,684,914 | 8/1987 | Wu | 439/622 |
| 4,768,979 | 9/1988 | Wu | 439/622 |
| 4,846,723 | 7/1989 | Pong | 439/686 |
| 4,904,976 | 2/1990 | Liaq | 439/622 |

*Primary Examiner*—Gary F. Paumen
*Assistant Examiner*—Kevin J. Carroll
*Attorney, Agent, or Firm*—Morton J. Rosenberg; David I. Klein

[57] ABSTRACT

This invention relates to a socket set, and more particularly to an improved socket set which provides an easy combination between a socket and a shell firmly. The invention includes a socket, a shell, and a connecter; and a pair of conductors are put into chambers of the socket which is then inserted into the shell, and then the assembled connecter is inserted into the opening of the shell, wherein two pairs of hooks formed on the connectors are respectively engaged with a pair of stops of the socket and sides of the opening, as well as a gap of the connecter engaged with a partition of the socket.

1 Claim, 5 Drawing Sheets

5
3
51

5
A
3
A
51
13
4
2
22
41
1

SOCKET SET

BACKGROUND OF THE INVENTION

This invention relates to a socket set, and more paricularly to an improved socket set which provides an easy combination between a socket and a shell firmly.

A prior known socket set is shown in FIG. 5 and includes a socket (1) and a shell (2). A pair of wires (3) are manually combined with a pair of conductors (4) to be put into a pair of chambers (11) of the socket (1) which is then put into the shell (2). A pair of hooks (12) are provided at the end of the socket (1) to engage with sides of an opening (21) of the shell (2). The manufacturing of the design is time consuming when combining the wires with the conductors. A main drawback is that the hooks (12) of the socket (1) are not effective in engaging with the shell (2) sometimes. As a plug is inserted into the scoket (1) and then pulled out, the socket (1) is usually pulled out and separated from the shell (2), which is very clangerous.

SUMMARY OF THE INVENTION

It is the purpose of this present invention, therefore, to mitigate and/or obviate the above-mentioned drawbacks i the manner set forth in the description of the preferred embodiment.

A primary objective of the present invention is to provide a socket set which eaisly combines a socket with a shell firmly.

A further objective of the present invention is to provide a socket set which can be assembled conveniently and manufactured rapidly.

Further objectives and advantages of the present invention will become apparent as the following description proceeds, and the features of novelty characterized by the claims annexed to and forming a part of this invention.

BRIEF DESCRIPTION OF THE DRAWINGS

As shown in FIGS. 2 and 3, the conductors (4) are put into the chambers (11) of the socket (1) which is then inserted into the shell (2). Now the assembled connecter (3) is inserted into the opening (21) of the shell (2), wherein the hooks (34) (35) are respectively engaged with a pair of stosp (13) of the socket (1) and the flanges (22) of the opening. (21) Also, the gap (36) of the connecter (3) is engaged with a partition (14) of the socket (1). It is understood that the combination therebetween is firm, and contact between the wires (5) and the conductors (4) becomes effective because of the protrusion (41) and the inclined tongues (52).

Referring to FIG. 2-A, the wire (5) is engaged with the connecter (3) firmly due to successional turns in the channel (32). It will not be trouble whenever pulling the wires carelessly.

Figure 1:
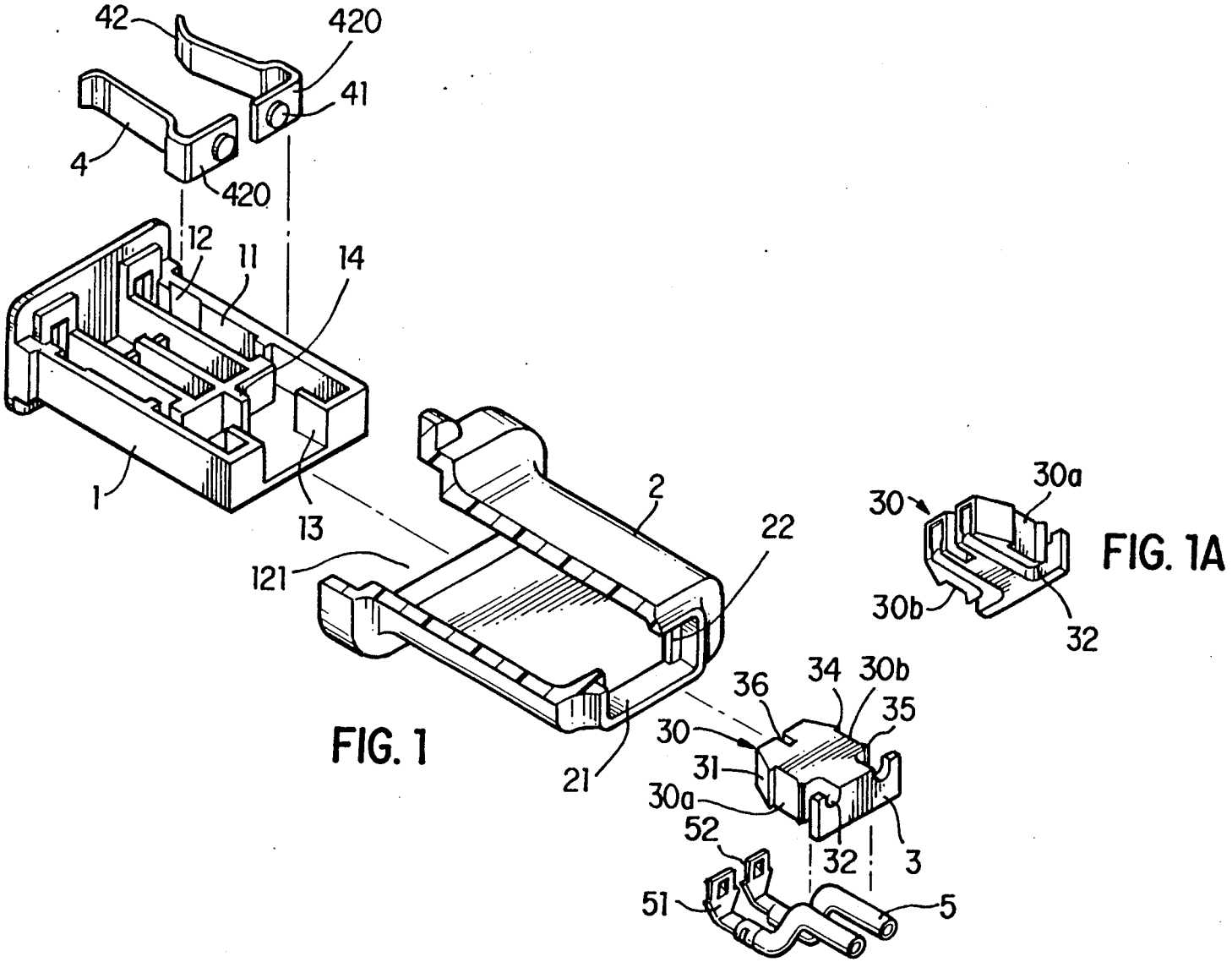
FIG. 1 is an exploded perspective view of a scoket set according to the present invention, FIG. 1-A is a perspective view of a connector of the present invention in FIG. 1.
Figures 2, 2A:
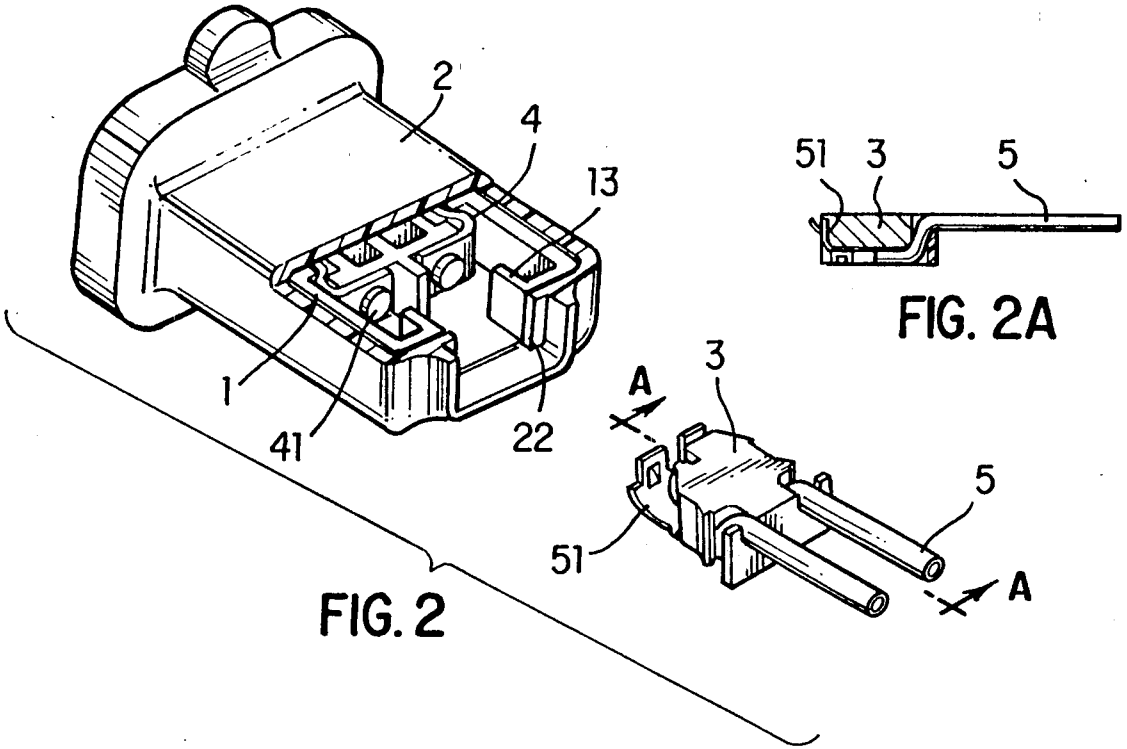
FIG. 2 is a perspective view of a semi-assembly of a socket set in accordance with the present invention, FIG. 2-A is a cross-sectional view of an connecter of the present invention in FIG. 2 taken along the Section Line AA.
Figure 3:
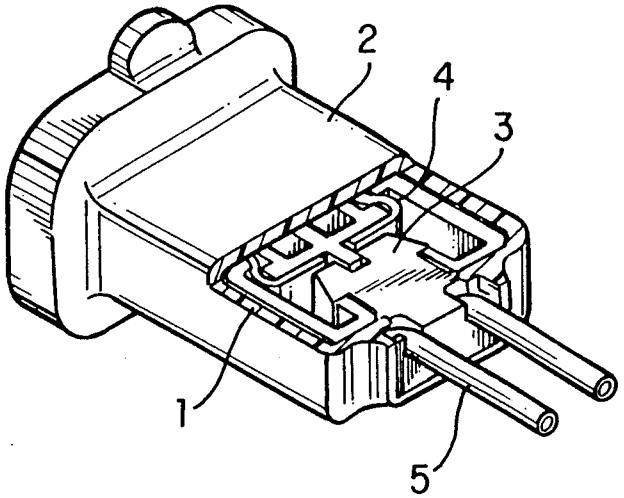
FIG. 3 is another perspective view of a semi-assembly of a socket set in accordance with the present invention.
Figure 4:
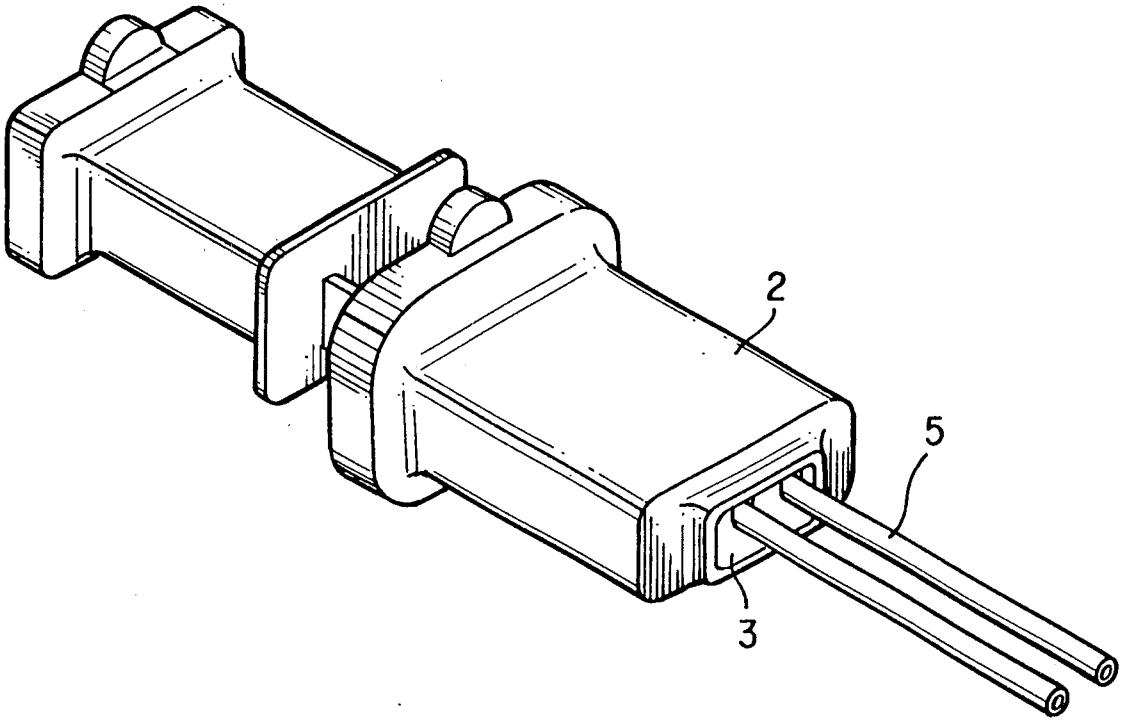
FIG. 4 is a perspective view of an assembly of a socket set in accordance with the present invention.
Figure 5:
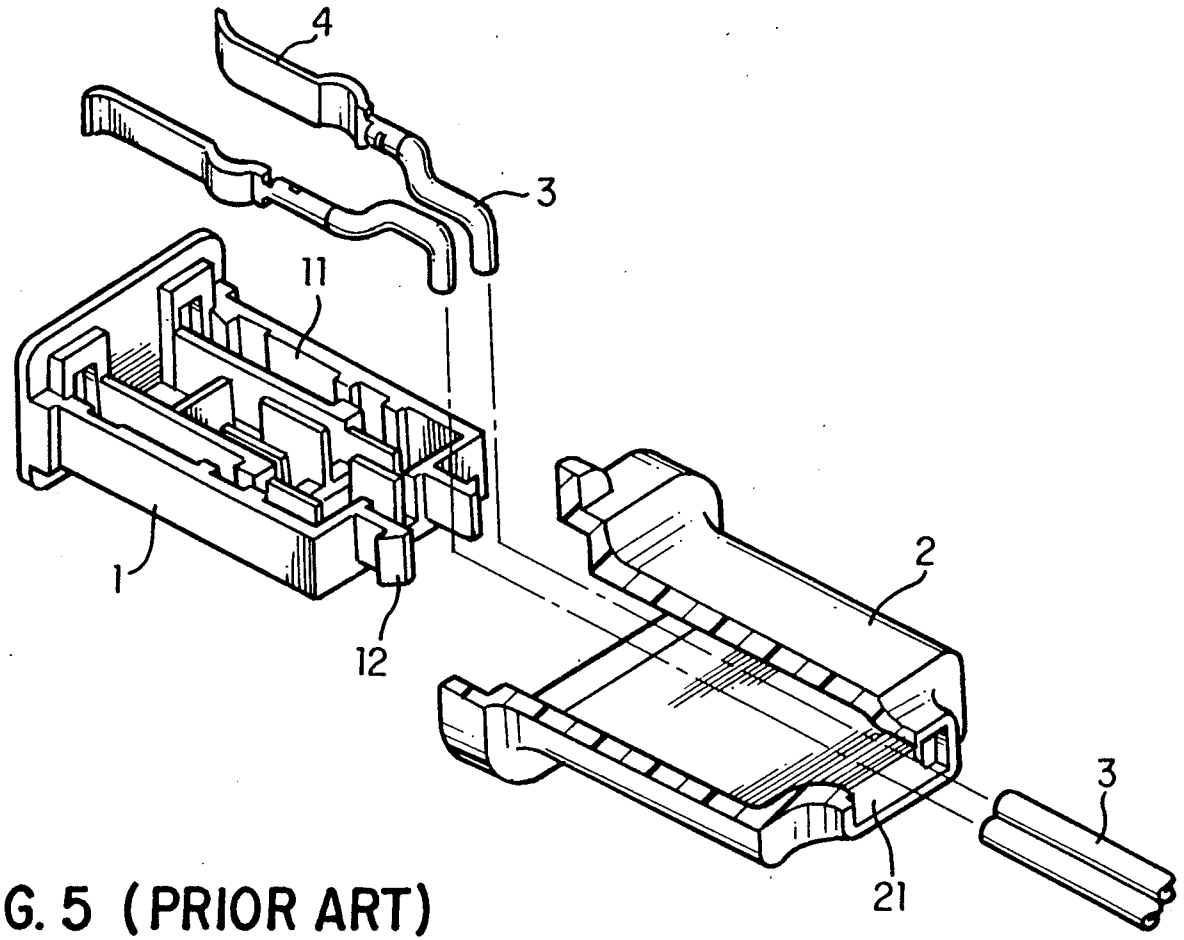
FIG. 5 (PRIOR ART)
FIG. 5 is an exploded perspective view of a prior known socket set. DETAILED DESCRIPTION OF THE PREFERRED EMBODIMENT Referring to the drawings and particularly to FIG. 1, it can be seen that the present invention includes a socket (1), a shell (2), and a connecter (3). A pair of chambers (11) are formed in the socket (1), each of which has a concavity (12). The shell (2) has a first opening (121) adapted to receive socket (1) and a second opening (21) adapted to receive a connector (3). A pair of flanges (22) that protrude into the interior of the second opening (21) are provided on the shell. A pair of conductors (4) are put into the chambers (11) of the socket (1). A first end end (42) of the conductor (4) is inclined to engage with the concavity (12) in the chamber (11). A second end (420) of the conductor (4) is provided with a protrusion (41). A pair of wires (5) combine with a pair of relative electric flanged spades (51) by automatic machines. The flanged spade (51) has an inclined tongue (52). The connecter (3) has a a front end (30) divided into two bases (31) by a gap (36). A pair of curved channels (32) are provided along the connecter (3), as shown in FIG. 1-A, where each channel extends from opposite sides (30*a*, 30*b*) of the connector (3) to a base (31). The said wires are then received in the relative channels (32) with the electric flanged spades (51) positioned before the front (33) of the connecter (3). A first and second pair of hooks, (34) and (35), respectively, are provided on two sides of the connector (3). The first pair of hooks (34) are adapted to engage the stops (13) of the socket (1). Ths second pair of hooks are adapted to engage the flanges (22) of the shell (2).

Form the aforesaid descriptions, it will be obvious that the present invention can be manufactured and assembled in ease and obtains a firm combination to prevent from dangers. It thus overcomes all drawbacks of the prior art.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I Claim:

1. A socket set comprising:

(a) a socket having a pair of chambers each of which has a concavity, a partition provided at a rear end of said chambers, a pair of conductors disposed in said chambers, wherein each conductor has a first end that engages said concavity and a secoond end that has a protrusion, said socket further including a pair of stops provided at said rear end of each of said chambers;

(b) a shell having a first opening adapted to receive said socket, a second opening adapted to receive a connector, and a pair of flanges provided at said second opening;

(c) said connector having a forward end divided into two bases by a gap, a pair of curved channels, each extending from opposite sides of said connector to a respective base, a first pair of hooks adapted to engage said stops of said socket, and a second pair of hooks adapted to engage said flanges of said shell, said paris of hooks located on the sides of said connector and adapted to prevent said connector from being removed from said second opening;

(d) a pair of wires disposed in said channels of said connector and combined with a pair of flanged spades having inclined tongues said pair of flanged spades respectively positioned on said two bases at the forward end of said connector;

(e) siad inclined tongues being in engagement with said protrusions of said conductors.

* * * * *